US006768461B2

(12) United States Patent
Huebner et al.

(10) Patent No.: US 6,768,461 B2
(45) Date of Patent: Jul. 27, 2004

(54) ULTRA-BROADBAND THIN PLANAR ANTENNA

(75) Inventors: Donald A. Huebner, Larkspur, CO (US); Raymond L. Lovestead, Superior, CO (US)

(73) Assignee: ARC Wireless Solutions, Inc., Wheat Ridge, CO (US)

( * ) Notice: Subject to any disclaimer, the term of this patent is extended or adjusted under 35 U.S.C. 154(b) by 27 days.

(21) Appl. No.: 10/218,002

(22) Filed: Aug. 13, 2002

(65) Prior Publication Data

US 2003/0034932 A1 Feb. 20, 2003

Related U.S. Application Data

(60) Provisional application No. 60/312,616, filed on Aug. 16, 2001.

(51) Int. Cl.[7] ..... H01Q 1/38
(52) U.S. Cl. ..... 343/700 MS; 343/830
(58) Field of Search ..... 343/700 MS, 829, 343/830, 848, 872, 793, 795, 807

(56) References Cited

U.S. PATENT DOCUMENTS

| | | | | | |
|---|---|---|---|---|---|
| 4,083,046 | A | * | 4/1978 | Kaloi | 343/700 MS |
| 4,160,976 | A | * | 7/1979 | Conroy | 343/700 MS |
| 4,605,933 | A | | 8/1986 | Butscher | |
| 4,987,421 | A | * | 1/1991 | Sunahara et al. | 343/700 MS |
| 5,933,115 | A | * | 8/1999 | Faraone et al. | 343/700 MS |
| 6,246,368 | B1 | * | 6/2001 | Deming et al. | 343/700 MS |
| 6,329,950 | B1 | | 12/2001 | Harrell et al. | |

* cited by examiner

*Primary Examiner*—Shih-Chao Chen
(74) *Attorney, Agent, or Firm*—Ancel W. Lewis, Jr.

(57) ABSTRACT

Ultra-broadband thin planar antenna has a flat elliptical element and a spaced rectangular element co-planar with the elliptical element. The inner conductor of a coaxial cable connects to the elliptical element near a gap between the elements and the outer conductor of the coaxial cable connects to the rectangular element. A housing encases the elliptical and rectangular elements and the transmission line. The antenna functions electrically as an asymmetrical planar dipole having a special configuration or as an elliptical planar monopole with a co-planar finite rectangular ground plane.

11 Claims, 1 Drawing Sheet

ULTRA-BROADBAND THIN PLANAR ANTENNA

This application claims the benefit under 35 U.S.C. §119(e) of the U.S. provisional patent application No. 60/312,616 filed Aug. 16, 2001.

TECHNICAL FIELD

The present invention relates to antennas and more particularly to a thin ultra-broadband antenna with conductive elements in a single plane.

BACKGROUND ART

The optimum three-dimensional shape for a broadband dipole, as concluded by antenna researchers, is a dipole consisting of two opposed "light bulb" shaped elements. The optimum shape for a broadband planar monopole over an orthogonal, infinite ground plane is believed to be elliptical or circular. The optimum shape for a planar dipole or a planar monopole with a co-planar finite ground plane has not previously been addressed.

U.S. Pat. No. 4,605,933 to Butscher discloses a microstrip antenna with a lower ground plane, a spaced rectangular upper ground plane and a circular radiating element coplanar with the upper ground plane. The disclosed antenna requires an impedance matching arrangement to connect to a transmission line. The disclosed antenna has the configuration of a microstrip antenna with the lower ground plane in a second spaced plane, and is thus not a planar antenna. U.S. Pat. No. 6,329,950 to Harrell et al. discloses a planar antenna with concentric elements. An inner circular element within a rectangular outer element is disclosed. The inner and outer elements are separated by a gap, but electrically connected across the gap by a shorting element and a coaxial cable feed.

The frequency range of 825 MHz to 6 GHz covers numerous wireless bands, including the cellular/GSM, PCS, ISM, MDS/MMDS and UNII bands. An ultra-broadband antenna that operates across the frequency range of 825 MHz to 6 GHz is desirable. A very thin ultra-broadband antenna that is simple and inexpensive to produce is also desirable.

DISCLOSURE OF THE INVENTION

An antenna includes an electrically conductive, planar antenna portion, a transmission line and a housing. The antenna portion has an elliptical first element and a rectangular second element. The first and second elements are spaced, adjacent and co-planar. The transmission line has a first conductor directly connected to the first element and a second conductor directly connected to the second element. The housing encloses the antenna portion.

BRIEF DESCRIPTION OF THE DRAWINGS

Details of this invention are described in connection with the accompanying drawings that bear similar reference numerals in which.

DETAILED DESCRIPTION OF THE INVENTION

Figure 1:
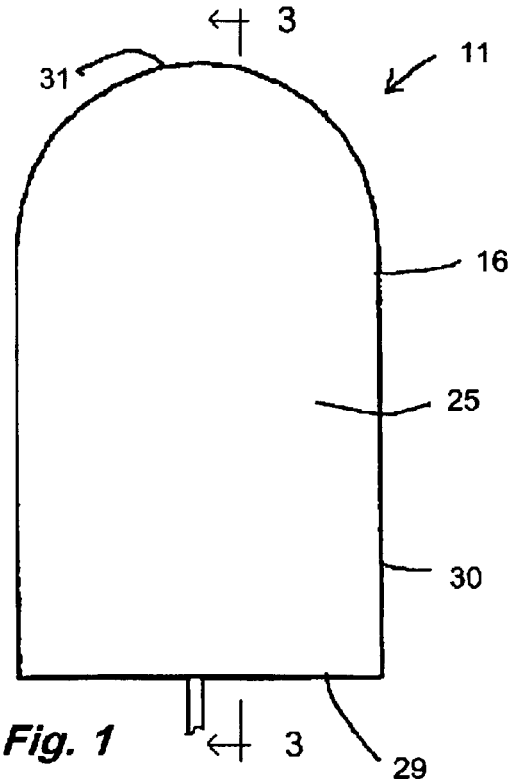
FIG. 1 is a front elevation view of an antenna embodying features of the present invention.
Figure 2:
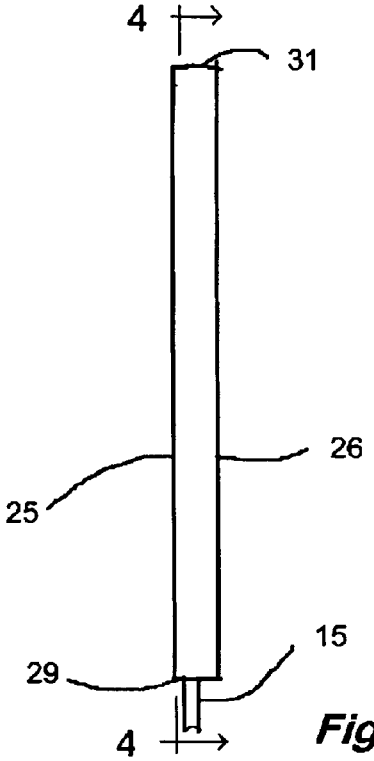
FIG. 2 is a side elevation view of the antenna of FIG. 1.
Figure 3:
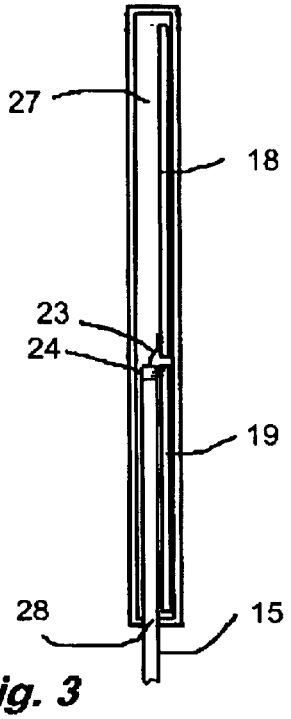
FIG. 3 is a sectional view taken along line 3—3 of FIG. 1.
Figure 4:
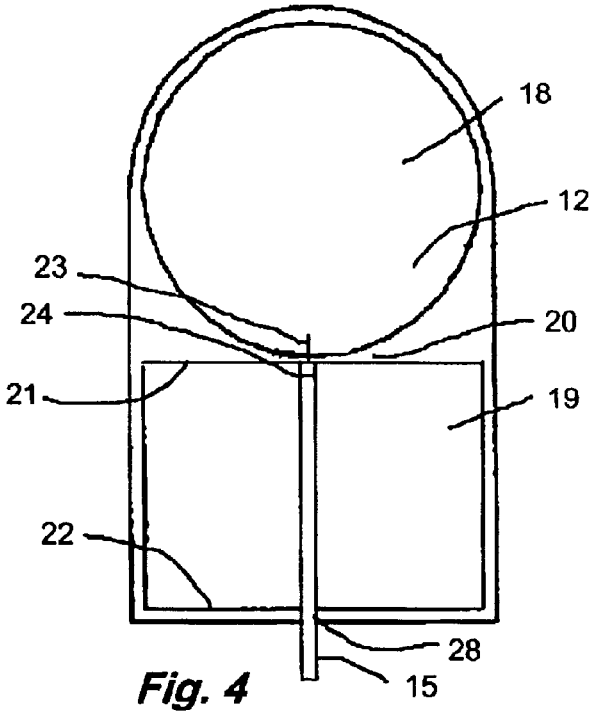
FIG. 4 is a sectional view taken along line 4—4 of FIG. 2.

Referring now to FIGS. 1, 2, 3 and 4, an antenna 11 embodying features of the present invention includes a planar, electrically conductive antenna portion 12, a transmission line 15, and a housing 16.

Describing the specific embodiments herein chosen for illustrating the invention, certain terminology is used which will be recognized as being employed for convenience and having no limiting significance. For example, the terms "top", "bottom", "front" and "back" will refer to directions with reference to the Figures. Further, all of the terminology above-defined includes derivatives of the word specifically mentioned and words of similar import.

The antenna portion 12 includes first and second elements 18 and 19 that are each a thin, flat, planar layer of conductive material such as copper. The first element 18 has an elliptical shape, preferably circular or round as illustrated, and the second element 19 has a rectangular shape. The first and second elements 18 and 19 are co-planar, and arranged in an adjacent, spaced, electrically isolated configuration, with the first element 18 above the second element 19 in the illustrated embodiment. A gap 20 of selected size is formed at the closest point between the first and second elements 18 and 19. The second element 19 has a first side 21 adjacent to the gap 20 and a spaced second side 22 opposite the first side 21. In the illustrated embodiment, the first side 21 is substantially centered relative to the first element 18, in order to minimize the outline of the antenna 11. The first and second elements 18 and 19 can be etched on copper clad substrate, silk screened using a conductive paste, or can be stamped from conductive sheet material.

The transmission line 15 has a first conductor 23 and a second conductor 24. In the illustrated embodiment the transmission line 15 is coaxial cable with the first conductor 23 being the inner conductor and the second conductor 24 being the conductive outer conductor. The first conductor 23 directly connects to the first element 18, preferably near the gap 20, and the second conductor 24 directly connects to the second element 19, preferably near the gap 20. Preferably the first conductor 23 is connected to the first element 18, and the second conductor 24 is connected to the second element 19, by soldering, but other connection methods are suitable The housing 16 has a front portion 25 and a back portion 26 that fit together to form a cavity 27 that is sized and shaped to receive the antenna portion 12. Preferably the front and back portions 25 and 26 are made from a plastic material but can be fabricated from any non-conductive material. In the illustrated embodiment, the transmission line 15 extends across the second element 19 and exits the housing 16 through a hole 28 in the bottom 29 of the housing 16. The transmission line 15 may alternately exit the housing through a side 30 or the top 31 of housing 16. After the antenna portion 12 and transmission line 15 are assembled into the cavity 27, the front and back portions are secured together by any known means, such as a snap together arrangement or plastic welding.

The antenna 11 of the present invention exhibits a dipole-like pattern and is essentially omnidirectional. Antenna 11 is ultra-broadband, having a bandwidth ratio of over 5 to 1. Antenna 11 may be viewed as an asymmetrical planar dipole having a special geometry or as an elliptical planar monopole with a finite, co-planar, rectangular ground plane. The transmission line connects directly to the antenna portion 12, and a balun or other matching device is not required.

The antenna 11 is very thin, and may also have a reduced length and width. By way of example, and not as a limitation, an antenna 11 designed to operate from 825 MHz to 6 GHz has the following dimensions. The diameter of the first element 18 and the width of the second element 19, taken parallel to the first side 21, are both 3.00", so that the overall width of the antenna portion 12 is 3.00". The length of the second element 19, taken perpendicular to the first side 21, is ¾ of the width or 2.25". The gap 20 is 0.02", so that the overall length of the antenna portion 12 is 5.27". Electromagnetic radiation at a frequency of 825 MHz has a wavelength of about 14.28", so the length of the antenna portion 12 is about 0.37 wavelengths and the width of the antenna portion 12 is about 0.21 wavelengths, at the lowest frequency of operation.

The illustrated embodiment of the antenna 11, with the housing 16, is particularly suitable for desktop use and vehicle windshield mounting. Antenna 11 may also be provided without housing 16 for other applications.

Although the present invention has been described with a certain degree of particularity, it is understood that the present disclosure has been made by way of example and that changes in details of structure may be made without departing from the spirit thereof.

What is claimed is:

1. An ultra-broadband thin planar antenna, for operation over a selected frequency range, comprising:

an antenna portion including flat, electrically conductive, coplanar first and second elements, with said first element being elliptical and said second element being rectangular, said first and second elements being adjacent, separated, and electrically isolated by a gap of selected size therebetween, and a transmission line having a first conductor directly connected to said first element and a second conductor directly connected to said second element.

2. The antenna as set forth in claim 1 wherein said first element is circular.

3. The antenna as set forth in claim 2 wherein said second element has a first side adjacent said gap and a width, measured parallel to said first side, substantially equal to a diameter of said first element.

4. The antenna as set forth in claim 1 including a housing having a front portion and a back portion that define a cavity sized and shaped to receive said antenna portion and said transmission line, with said transmission line extending from said housing.

5. The antenna as set forth in claim 1 wherein said second element has a first side adjacent said gap and said first element is substantially centered relative to said first side.

6. The antenna as set forth in claim 1 wherein said first and second elements are stamped from conductive sheet material.

7. The antenna as set forth in claim 1 wherein said first and second elements are etched from a copper clad substrate.

8. The antenna as set forth in claim 1 wherein said antenna portion has a width that is about 0.21 wavelengths at a lowest frequency in said frequency range and a length that is about 0.37 wavelengths at said lowest frequency.

9. The antenna as set forth in claim 1 wherein said transmission line is a coaxial cable with an inner conductor and an outer conductor, said first conductor being said inner conductor and said second conductor being said outer conductor.

10. An ultra-broadband thin planar antenna, for operation over a selected frequency range, comprising:

an antenna portion including flat, electrically conductive, coplanar first and second elements stamped from copper sheet material, with said first element being circular and said second element being rectangular, said first and second elements being adjacent, separated and electrically isolated by a gap of selected size therebetween, said second element having a first side adjacent said gap and said first element being substantially center relative to said first side, said second element having a width, measured parallel to said first side, substantially equal to a diameter of said first element, said antenna portion having a width that is about 0.21 wavelengths at a lowest frequency in said frequency range and a length that is about 0.37 wavelengths at said lowest frequency a coaxial cable having an inner conductor directly connected to said first element and an outer conductor directly connected to said second element, and a housing having a nonconductive front portion and a nonconductive back portion that define a cavity sized and shaped to receive said antenna portion and said coaxial cable, with said coaxial cable extending from said housing.

11. An ultra-broadband thin planar antenna, for operation over a selected frequency range, comprising:

an antenna portion consisting essentially of flat, electrically conductive, coplanar first and second elements, with said first element being elliptical and said second element being rectangular, said first and second elements being adjacent, separated, and electrically isolated by a gap of selected size therebetween, and a transmission line having a first conductor directly connected to said first element and a second conductor directly connected to said second element.

* * * * *